US005441840A

United States Patent [19]

Imai et al.

[11] Patent Number: 5,441,840

[45] Date of Patent: Aug. 15, 1995

[54] CAPSULE TONER AND PROCESS FOR PRODUCING THE SAME

[75] Inventors: Takashi Imai; Takeshi Agata; Tadeshi Mikami; Yoshihiro Inaba, all of Minami-Ashigara, Japan

[73] Assignee: Fuji Xerox Co., Ltd., Tokyo, Japan

[21] Appl. No.: 160,168

[22] Filed: Dec. 2, 1993

[30] Foreign Application Priority Data

Dec. 2, 1992 [JP] Japan ..... 4-345092

[51] Int. Cl.[6] ..... G03G 9/093

[52] U.S. Cl. ..... 430/109; 430/138

[58] Field of Search ..... 430/109, 138

[56] References Cited

U.S. PATENT DOCUMENTS 5,077,167 12/1991 Ong et al. ..... 430/109
5,082,757 1/1992 Keoshkerian et al. ..... 430/109 X
5,153,068 10/1992 Kohara et al. ..... 428/405

*Primary Examiner*—Roland Martin
*Attorney, Agent, or Firm*—Oliff & Berridge

[57] ABSTRACT

A novel capsule toner obtained by dispersing an oil phase containing a binder resin and a colorant in an aqueous phase in the form of oil droplets so that one or more capsule shell-forming monomers are allowed to undergo reaction inside and/or on the interface of the oil droplets to form capsule shells is provided, wherein a silylisocyanate compound is added in the oil phase as the capsule shell-forming monomer.

15 Claims, 2 Drawing Sheets

CAPSULE TONER AND PROCESS FOR PRODUCING THE SAME

FIELD OF THE INVENTION

The present invention relates to an electrophotographic capsule toner for use in development of electrostatic latent images in an electrophotographic process, an electrostatic recording process, etc. and a process for producing the capsule toner.

BACKGROUND OF THE INVENTION

Most electrophotographic toners are prepared by a melt kneading process. In the melt kneading process, a resin, a colorant, an antistatic agent, etc. are melt-kneaded, pulverized, and then classified to obtain grains. Recently, color or high resolution copying machines and printers employing electrophotographic processes become more popular. Toners for these apparatus have been accordingly required to have high performances. Further, due to its growing requirement for high performance, the hardware such as copying machines and printers has been rapidly complicated and thus has required a large amount of power. Thus, the hardware has been required to minimize the fixing energy. Accordingly, for the part of the toner for use with these copying machines or printers, finer grains have been required for fixability at a low temperature and high resolution. However, when finely divided toner grains are prepared by the melt kneading process, the classification yield is particularly poor, increasing the production cost. Further, if a low-temperature fixable material is used, it causes toner fusion in the pulverizer, lowering the productivity.

A wet process is considered to be an efficient process for the preparation of finely divided toner grains in a high yield. Examples of such a wet process include a supspension polymerization process, an emulsion polymerization process, and a dispersion polymerization process. Many processes have heretofore been proposed.

However, toners obtained by such a wet process are still insufficient in toner properties such as pigment dispersibility, cleaning properties, environmental stability of chargeability and sharpness of grain size distribution, as compared with those obtained by the melt kneading process. In particular, due to its nonuniform pigment dispersion and nonuniform location of charging sites on the surface of the toner, the toner obtained by the wet process is disadvantageous in that its chargeability varies so that a blur around the image occurs, making it impossible to obtain a high resolution image. Further, the inferior toner chargeability and charge distribution have adverse influence on toner scattering in copying machines or printers employing electrophotographic process and on developer life. Moreover, the problem of disposal of waste liquid must be solved. Therefore, no wet process has been put into practical use.

SUMMARY OF THE INVENTION

It is therefore an object of the present invention to provide an electrophotographic capsule toner having a sharp grain size distribution which exhibits improved cleaning properties and environmental stability of chargeability and can provide stable images with a high resolution.

Another object of the present invention is to provide an electrophotographic capsule toner having an excellent pigment dispersibility.

A further object of the present invention is to provide an electrophotographic capsule toner which can be fixed at a low temperature.

A still further object of the present invention is to provide an electrophotographic capsule toner every grain of which has a little fluctuation in chargeability.

These and other objects of the present invention will become more apparent from the following detailed description and examples.

As a result of extensive studies, the inventors have found that in preparation of grains by mechanically emulsifying an aqueous phase and an oil phase and effecting an interfacial polymerization, addition of a silylisocyanate compound in the oil phase provides a capsule toner having a narrower grain size distribution than that prepared by a conventional wet process. The present invention has been achieved based on the discovery.

A first embodiment of the present invention is a capsule toner obtained by dispersing an oil phase containing a binder resin and a colorant in an aqueous medium in the form of oil droplets and effecting a reaction of one or more capsule shell-forming monomers inside and/or on the interface of the oil droplets to form capsule shells, wherein a silylisocyanate compound is added in the oil phase as a capsule shell-forming monomer.

A second embodiment of the present invention is a capsule toner obtained by dispersing an oil phase containing a binder resin and a colorant in an aqueous medium in the form of oil droplets and effecting a reaction of at least a first capsule shell-forming monomer and a second capsule shell-forming monomer inside and/or on the interface of the oil droplets to form capsule shells, wherein a silylisocyanate compound and a polyvalent isocyanate compound are added in the oil phase as capsule shell-forming monomers and a cellulose high molecular compound is added in the aqueous medium.

DETAILED DESCRIPTION OF THE INVENTION

Figure 1:
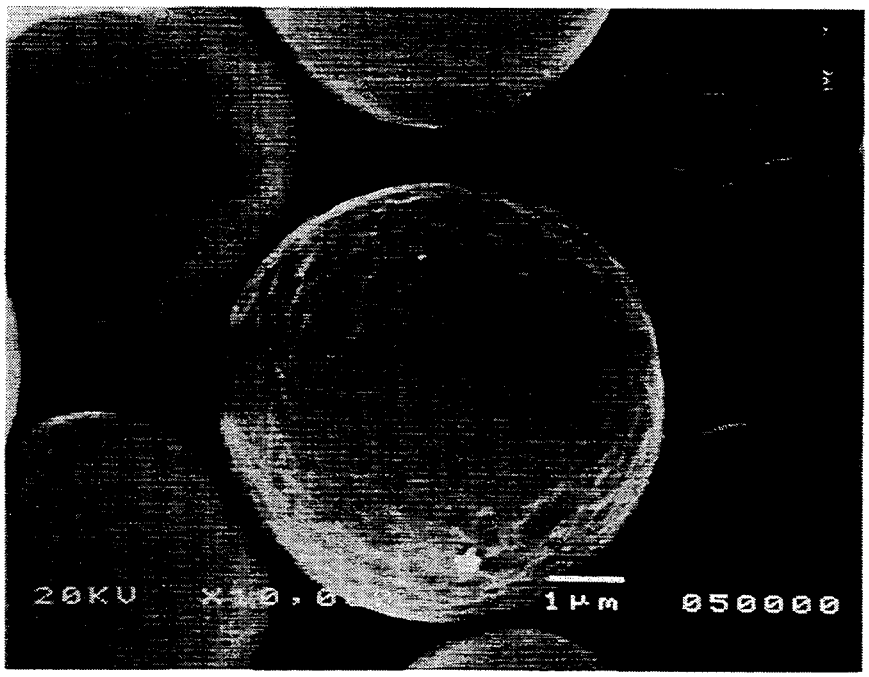
FIGS. 1, 2 and 3 are photographs of various capsule toner grains of the present invention obtained by a scanning type electron microscope.

The capsule toner of the present invention is a so-called microcapsule toner comprising a capsule shell formed around a core material having a colorant incorporated in a binder resin. In the present invention, such a microcapsule toner is prepared by a microcapsule forming process which comprises allowing one or more capsule shell-forming monomers, e.g., a first capsule shell-forming monomer and a second capsule shell-forming monomer to undergo reaction with each other inside and/or on the interface of oil droplets to form capsule shells.

One of microcapsule forming processes is an in-situ polymerization process as disclosed in JP-B-49-45131 and JP-B-50-22507 (the term "JP-B" as used herein means an "examined Japanese patent publication"), which comprises allowing a first capsule shell-forming monomer and a second capsule shell-forming monomer to undergo polymerization inside and on the interface of oil droplets to form capsule shells. In this process, the first capsule shell-forming monomer and the second capsule shell-forming monomer are incorporated in a pigment dispersion which is then dispersed in an aqueous medium in the form of oil droplets in which these capsule shell-forming monomers are polymerized to form capsule shells.

Another microcapsule forming process is an interfacial polymerization process as disclosed in JP-B-38-19574, JP-B-42-446, JP-B-58-66948, JP-B-59-148066, JP-B-59-162562, and JP-B-2-31381, which comprises allowing a first capsule shell-forming monomer present in oil droplets and a second capsule shell-forming monomer present outside the oil droplets to undergo reaction on the interface of the oil droplets to form capsule shells. In this process, the first capsule shell-forming monomer is incorporated in an aqueous phase while the second capsule shell-forming monomer is incorporated in the oil droplets of the pigment dispersion. These capsule shell-forming monomers are polymerized on the interface of the droplets to form capsule shells.

Alternatively, the two processes may be combined so that the two capsule shell-forming monomers are polymerized inside and on the interface of oil droplets.

In the first embodiment of the present invention, a silylisocyanate compound is added as a capsule shell-forming monomer in the oil phase containing a binder resin and a colorant. Examples of the silylisocyanate compound to be used in the present invention include silylisocyanate derivatives represented by following general formulae (I), (II) and (III) and condensates thereof:

$$R_mR'_kR''_nSi(NCO_{4-m-k-n} \quad (I)$$

$$(RO)_m(R'O)_k(R''O)_nSi(NCO)_{4-m-k-n} \quad (II)$$

$$R_p(R'O)_qSi(NCO)_r \quad (III)$$

wherein R, R' and R'' each represents an alkyl group preferably having 1 to 4 carbon atoms, an aryl group, preferably a phenyl group, or an alkenyl group preferably having 2 to 3 carbon atoms; m, k and n each represents an integer of 0 to 3, with the proviso that m, k and n satisfy the relationship $m+K+n\leqq 3$; and p, q and r each represents an integer of 1 or 2, with the proviso that p, q and r satisfy the equation $p+q+r=4$.

Specific examples of such a silylisocyanate derivative include $(CH_3)_3SiNCO$, $(C_2H_5)_3SiNCO$, $(C_3H_7)_3SiNCO$, $(C_4H_9)_3SiNCO$, $(CH_3)(C_2H_5)(C_3H_7)SiNCO$, $(CH_3)(C_2H_5)_2SiNCO$, $(CH_3)_2(C_2H_5)SiNCO$, $(CH_3)_3SiNCO$, $(CH_3)_2Si(NCO)_2$, $(C_2H_5)_2Si(NCO)_2$, $(C_3H_7)_2Si(NCO)_2$, $(C_4H_9)_2Si(NCO)_2$, $CH_3Si(NCO)_3$, $C_2H_5Si(NCO)_3$, $C_3H_7Si(NCO)_3$, $C_4H_9Si(NCO)_3$, $CH_2{=}CHSi(NCO)_3$, $CH_2{=}C(CH_3)Si(NCO)_3$, $(CH_3O)_3SiNCO$, $(C_2H_5O)_3SiNCO$, $(C_3H_7O)_3SiNCO$, $(C_4H_9O)_3SiNCO$, $(CH_3O)_2Si(NCO)_2$, $(C_2H_5O)_2Si(NCO)_2$, $(C_3H_7O)_2Si(NCO)_2$, $(C_4H_9O)_2Si(NCO)_2$, $CH_3OSi(NCO)_3$, $C_2H_5OSi(NCO)_3$, $C_3H_7OSi(NCO)_3$, $C_4H_9OSi(NCO)_3$, $Si(NCO)_4$, $(CH_3)(CH_3O)_2SiNCO$, $(C_2H_5)(C_2H_5O)_2SiNCO$, $(C_3H_7)(C_2H_5O)_2SiNCO$, $(C_4H_9)(C_3H_7O)Si(NCO)_2$, $(CH_3)(CH_3O)Si(NCO)_2$, $(C_2H_5)(C_2H_5O)Si(NCO)_2$, $(C_3H_7)(C_2H_5O)Si(NCO)_2$, $(C_4H_9)(C_2H_5O)Si(NCO)_2$, $(C_6H_5O)Si(NCO)_3$, and $(C_6H_5)_2Si(NCO)_2$.

These silylisocyanate derivatives may be used singly or in admixture. Further, condensates of the above silylisocyanate derivatives can also be used.

The silylisocyanate compound may be used in an amount of 0.0001 to 0.5 parts by weight, preferably 0.01 to 0.10 parts by weight, per part by weight of the total weight of the binder resin and colorant constituting the core material.

The oil phase may comprise a polyvalent isocyanate compound (as described later) incorporated therein together with the foregoing silylisocyanate compound.

The binder resin constituting the core material of the capsule toner of the present invention is not specifically limited. Specific examples of the binder resin include polyester, polyurethane, polyurea, polystyrene, styrene-alkyl methacrylate copolymer, styrene-alkyl acrylate copolymer, styrene-acrylonitrile copolymer, styrene-butadiene copolymer, styrene-maleic anhydride copolymer, polyethylene, and polypropylene. These binder resins may be incorporated in the core material therein singly or in admixture.

Preferred among these binder resins is polyester. In particular, a linear polyester made of a polycondensate of a polyol component with a polyvalent carboxylic acid, acid anhydride thereof or lower alkylester thereof is preferably used. Preferred polyol components are two diols represented by following general formulae (1) and (2):

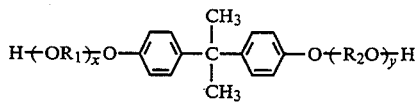

(1)

wherein $R_1$ and $R_2$ each represents an ethylene group or propylene group; and x and y each represents an integer of 1 or more.

$$HO{-}(CH_2)_z{-}OH \quad (2)$$

wherein z represents an integer of 2 to 6.

Specific preferred examples of the diol represented by formula (1) include polyoxypropylene (2,2) -2,2-bis (4-hydroxyphenyl)propane, and polyoxypropylene(3,3)-2,2-bis(4-hydroxyphenyl)propane.

Specific preferred examples of the diol represented by formula (2) include ethylene glycol, 1,3-propylene glycol, and 1,4-butanediol.

The foregoing diols may be used singly or in admixture.

Specific preferred examples of the polyvalent carboxylic acid include divalent carboxylic acids such as phthalic acid, isophthalic acid, terephthalic acid, fumaric acid, maleic acid, and succinic acid, and trivalent carboxylic acids such as 1,2,4-benzentricarboxylic acid, 2,5,7-naphthalenetricarboxylic acid, and 1,2,4-naphthalenetricarboxylic acid.

These polyvalent carboxylic acids may be used singly or in admixture.

Typical examples of the colorant as a constituent of the core material include carbon black, nigrosine, aniline blue, chalcoyl blue, chrome yellow, ultramarine blue, Du Pont oil red, quinoline yellow, methylene blue chloride, phthalocyanine blue, malachite green oxalate, lamp black, rose bengale, C. I. pigment red 48 : 1, C. I. pigment red 122, C. I. pigment red 57 : 1, C. I. pigment yellow 97, C. I. pigment yellow 12, C. I. pigment blue 15: 1, C. I. pigment blue 15 : 3, and magnetic powder.

On the other hand, the aqueous phase to be used for the emulsification of the foregoing oil phase may comprise a protective colloid incorporated therein. As such a protective colloid there may be used a water-soluble high molecular compound. Such a water-soluble high molecular compound may be properly selected from the group consisting of known anionic high molecular compounds, nonionic high molecular compounds, and amphoteric high molecular compounds. In particular, polyvinyl alcohols, gelatin and cellulose water-soluble high molecular compounds are preferred.

Further, the aqueous phase may comprise a surface active agent incorporated therein. As such a surface active agent there may be used any compound which does not interact with the foregoing colloid to cause precipitation or agglomeration. Such a surface active agent may be selected from the group consisting of anionic and nonionic surface active agents. Preferred examples of such a surface active agent include sodium alkylbenzenesulfonate (e.g., sodium laurylsulfate), dioctylsodium sulfosuccinate, and polyalkylene glycol (e.g., polyoxyethylene nonylphenyl ether). If necessary, the aqueous phase may further comprise an alcohol or amine which reacts with the silylisocyanate compound.

In order to prepare oil droplets, the foregoing binder resin, colorant and silylisocyanate compound are dissolved or dispersed in an organic solvent to obtain an oil phase which is then added to an aqueous phase. Particularly preferred examples of such an organic solvent include ethyl acetate, isopropyl acetate, butyl acetate, and methylene chloride.

Referring now to the second embodiment of the present invention, the first capsule shell-forming monomer to be used in the preparation of the capsule toner may be a polyol a polyamine or water which reacts with a silylisocyanate compound and a polyvalent isocyanate compound as described later.

As polyols there may be used polyvalent aliphatic or aromatic alcohols, hydroxypolyesters, and hydroxypolyalkylene ethers. For example, polyols as disclosed in JP-A-60-49991 may also be used. (The term "JP-A" as used herein means an "unexamined Japanese patent application".) Specific examples of such polyols include ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-l,3-propanediol, 2,4-pentanediol, 2,5-hexanediol, 3-methyl-l,5-pentanediol, 1,4-cyclohexanedimethanol, dihydroxy cyclohexane, diethylene glycol, 1,2,6-trihydroxyhexane, 2-phenylpropylene glycol, 1,1,1-trimethylolpropane, hexanetriol, pentaerythritol, pentaerythritol-ethylene oxide adduct, glycerin-ethylene oxide adduct, glycerin, 1,4-di(2-hydroxyethoxy)benzene, condensate of polyvalent aromatic alcohol and alkylene oxide such as resorcinol dihydroxyethyl ether, p-xylylene glycol, m-xylylene glycol, $\alpha$, $\alpha'$-dihydroxy-p-diisopropylbenzene, 4,4'-dihydroxy-diphenylmethane, 2-(p,p'-dihydroxydiphenylmethyl)benzyl alcohol, adduct of bisphenol A with ethylene oxide, and adduct of bisphenol A with propylene oxide.

Examples of the polyamines include ethylenediamine, trimethylenediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine, and amine adduct of epoxy compound.

The first capsule shell-forming monomer other than water may be incorporated in either the oil phase or the aqueous phase or both. The amount of the first capsule shell-forming monomer, i.e., the polyol or polyamine is preferably from 0.02 to 2 mol as calculated in terms of hydroxy group or amine group per mol of isocyanate group contained in the silylisocyanate compound and polyvalent isocyanate compound reacted. Water is present as a dispersion medium and the amount of water is not limited as the first capsule shell-forming monomer.

On the other hand, as the second capsule shellforming monomer there may be used a polyvalent isocyanate compound.

Examples of polyvalent isocyanate compounds include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4-biphenyl-diisocyanate, 3,3'-dimethylphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate and cyclohexylene-1,4-diisocyanate, trisocyanates such as 4,4',4''-triphenylmethane triisocyanate and toluene-2,4,6-triisocyanate, tetraisocyanates such as 4,4'-dimethyldiphenylmethane-2,2',5,5'-tetraisocyanate, and isocyanate prepolymers such as adduct of hexamethylene diisocyanate and trimethylolpropane, adduct of 2,4-tolylene diisocyanate and trimethylolpropane, adduct of xylylene diisocyanate and trimethylolpropane and adduct of tolylene diisocyanate and hexanetriol. Of these, triisocyanates and isocyanate prepolymers are preferred, and xylene-1,4-diisocyanate and adduct of xylene diisocyanate and trimethylolpropane are particularly preferred.

The second capsule shell-forming monomer may be incorporated in the oil phase, and the amount thereof is preferably in the range of 0.005 to 0.50 parts by weight, more preferalby 0.01 to 0.30 parts by weight, per part by weight of the total weight of the binder resin and colorant constituting the core material.

Besides the foregoing polyvalent isocyanate compound, the oil phase further comprises a silylisocyanate compound incorporated therein. Examples of such a silylisocyanate compound which can be used in the present invention include silylisocyanate derivatives represented by the foregoing general formulae (I), (II) and (III) and condensates thereof. Specific examples of these compounds include those described above. The amount of the silylisocyanate compound to be used is in the range of 0.0001 to 0.5 parts by weight, preferably 0.01 to 0.10 parts by weight, per part by weight of the total weight of the binder resin and colorant constituting the core material.

On the other hand, the aqueous phase to be used in the emulsification of the foregoing oil phase may comprise a cellulose water-soluble high molecular compound incorporated therein. The cellulose water-soluble high molecular compound preferably has a polymerization degree of from 500 to 1,500 and more preferably from 700 to 1,300.

As such a cellulose water-soluble high molecular compound there may be used a known cellulose water-soluble high molecular compound, and examples thereof include viscose, methyl cellulose, ethyl cellulose, hydroxyethyl cellulose, and carboxymethyl cellulose. Such a water-soluble high molecular compound may be used in the form of aqueous solution in a concentration of 0.01 to 10% by weight, preferably 0.1 to 5% by weight.

The aqueous phase may comprise the foregoing surface active agent incorporated therein.

In the second embodiment, oil droplets are formed by dissolving or dispersing the foregoing binder resin, colorant, polyvalent isocyanate compound, silylisocyanate compound, etc., in the foregoing organic solvent which is then added to an aqueous phase and emulsified by means of a mechanical power. The first capsule shell-forming monomer, i.e., polyols and polyamines, are contained in the aqueous phase if not contained in the oil droplets.

The resulting system is optinally heated so that polymerization occurs on the interface of oil droplets to produce grains. The system may be desolvated at the same time with or after the interfacial polymerization reaction.

After the interfacial polymerization reaction and desolvating, a capsule toner can be obtained by separating the grains from the aqueous phase, washing the grains, and then drying the grains.

The grain size of the capsule toner according to the present invention is preferably not more than 20 μm, particularly 1 μm to 10 μm as calculated in terms of volume-average grain size as determined by the measurement process disclosed in JP-A-60-214990 particularly from the standpoint of enhancement of image resolution, preservability and handleability.

The capsule toner of the present invention may optionally comprise an additive such as known antistatic agent and fixing aid incorporated therein. Further, an external additive such as fluidizer, e.g., silica, titania and alumina, cleaning aid, e.g., polystyrene grains, polymethyl methacrylate grains and polyvinylidene fluoride grains and transferring aid may be used.

An electrophotographic toner composition comprising the capsule toner of the present invention may be used as a one-component type developer free of carrier or a two-component type developer comprising a carrier and the capsule toner, with the latter being preferred.

The carrier, if used, is not specifically limited so far as it is a known carrier. For example, iron powder carrier, ferrite carrier, surface-coated ferrite carrier, magnetic powder-dispersed carrier, etc. can be used.

In the present invention, the silylisocyanate compound to be used as a substance which initiates the interfacial reaction reacts rapidly with water in the aqueous phase to form a silicon-oxygen bond on the interface between the oil phase and the aqueous phase, with removal of $NH_3$ and $CO_2$. The mechanism by which the objects of the present invention are accomplished is not clear but it is assumed as follows. When the foregoing silylisocyanate compound is added to an oil phase in admixture and then mechanically dispersed in an aqueous phase, the silylisocyanate compound can easily imigrate to the water-oil interface due to its higher hydrophilicity than other substances in the oil phase and then rapidly reacts with water or other substances on the interface. Thus, the oil phase is isolated from the aqueous phase, allowing the colorant contained in the oil phase to present with its excellent dispersibility maintained. Therefore, no grains free of colorant are produced, and the colorant is uniformly dispersed in the grains. Further, since the silylisocyanate compound rapidly reacts with water or other substances, the agglomeration of oil droplets in the aqueous phase is inhibited, giving almost uniform grain diameters according to the mechanical power. Thus, a sharp grain size distribution can be obtained. The grains thus obtained have a sharp grain diameter distribution. Further, the surface of the grains is a shell having a uniform Si-O bond distribution. Accordingly, an electrophotographic toner having a small dispersion of chargeability from grain to grain can be obtained.

In one preferred embodiment of the present invention, the preparation of a capsule toner which comprises mechanically emulsifying an aqueous phase of an aqueous solution of a cellulose water-soluble high molecular compound and an oil phase containing an organic polyvalent isocyanate compound and a silylisocyanate compound and effecting an interfacial polymerization can provide grains having a sharper grain size distribution in a high yield, as compared to the conventional wet process. The mechanism of attaining the sharp grain size distribution is not clear but it is assumed as follows.

In general, the intrinsic emulsion grain diameter of emulsion grains mechanically obtained from an oil phase-aqueous phase system is considered to be defined as the grain diameter of grains which can be obtained by application of the maximum shear stress to the liquid. If there is no agglomeration of emulsion grains and all grains are produced by application of the maximum shear stress, the grain size distribution becomes sharp.

In the present invention, if an aqueous solution of a cellulose high molecular compound having a relatively high viscosity is used, the oil droplets obtained by the mechanical emulsification are hardly agglomerated due to their viscosity. Further, due to the organic polyvalent isocyanate compound and silylisocyanate compound contained in the oil phase, a reaction takes place, momentarily with water or substances contained in the aqueous phase to form an interfacially polymerized wall that inhibits the agglomeration of grains, resulting in a sharp grain size distribution.

In accordance with the present invention, the grain size distribution of the capsule toner can be sharp. As a result, the irregularity of chargeability is reduced, giving a more uniform chargeability. Further, finely divided grains in the toner grain size distribution can be reduced, improving the cleaning properties. Accordingly, a stable image with a high resolution can be obtained.

Figure 2:
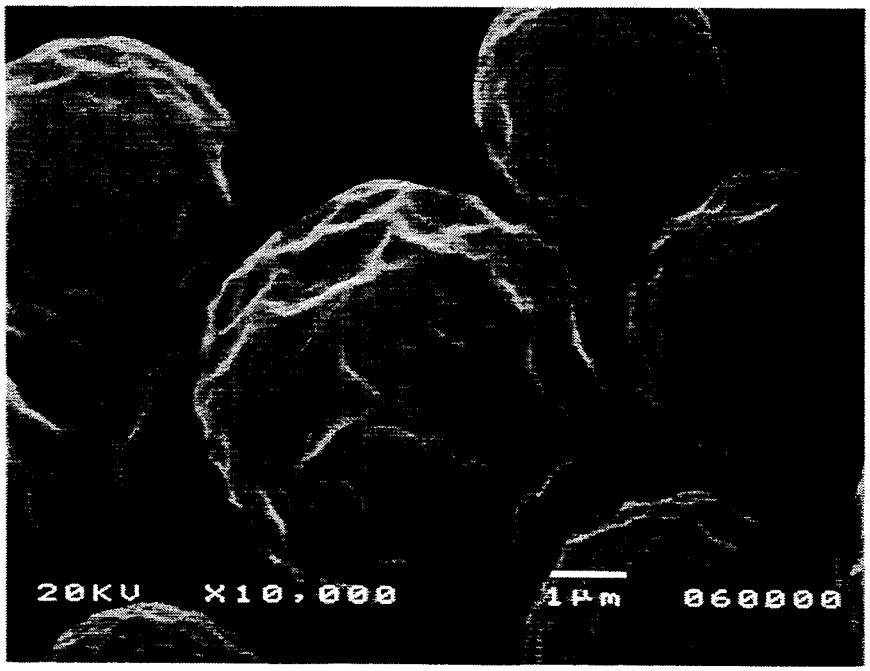
Figure 3:
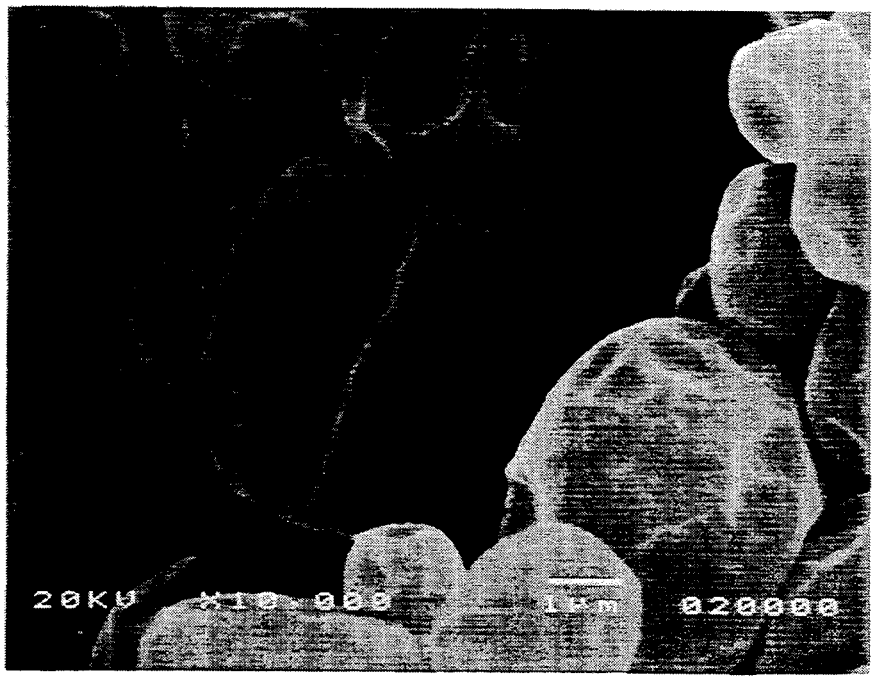

In the preparation of capsule toner grains according to the present invention, the grain shape of the capsule toner can be arbitrarily varied from nearly sphere to amorphous by varying the content of the polyvalent isocyanate compound and the content of the silylisocyanate compound (see FIGS. 1 to 3). Thus, the technical problems with copying machines and printers employing a high resolution toner can be eliminated. For example, fog, unevenness in the transferring zone, toner miscarriage, etc. can be inhibited. The capsule toner according to the present invention can be easily suited to copying machines or printers.

The present invention will be further described in the following Examples, but the present invention should not be construed as being limited. The term "parts" as used in these Examples and Comparative Examples means "parts by weight".

EXAMPLE 1

Two parts of a linear polyester resin (Tg: 46° C.; Tm: 80° C.; acid value: 2.7; hydroxyl number: 34.4), 2 parts of a copper-phthalocyanine pigment (Phthalocyanine Blue 4933M, available from Dainichi Seika K.K.), 0.15 parts of Solspurse 5000 (available from ICI Japan) as a pigment dispersant, 0.55 parts of Solspurse 24000 (available from ICI Japan) as a pigment dispersant, and 200 parts of ethyl acetate were mixed and treated by means of a sand mill to prepare a dispersion.

To 20 parts of the dispersion were then added 20 parts of the foregoing linear polyester resin and 1 part of methylsilyl triisocyanate (Orgatics SI-310, available from Matsumoto Kosho K.K.) to prepare an oil phase. The addition of methylsilyl triisocyanate was effected shortly before mixing the oil phase and the aqueous phase described below.

As the aqueous phase there was used 80 parts of a 0.1 wt. % aqueous solution of a polyvinyl alcohol. The oil phase was then emulsion-dispersed in the aqueous phase using a household mixer. Thus, an oil-in-water type emulsion comprising oil droplets having an average grain diameter of 5 μm was obtained. The oil-in-water type emulsion was stirred in a 40° C. constant temperature bath for 3 hours to evaporate ethyl acetate. The oil droplets in the emulsion exhibited a volume-average grain size of 4.5 μm, a number-average grain diameter of 4.0 μm and a grain size distribution of 1.34 as determined by Coulter counter process. The grain size distribution was calculated by the following equation $$\text{Grain size distribution} = \sqrt{\frac{D_{16}}{D_{84}}}$$

wherein $D_{16}$ and $D_{84}$ are the diameters of grain at which the integrated volume of the grains from large to small ones reached 16% and 84%, respectively, of the volume of the whole grains. Thus, the emulsion was in a level such that no classification process is required.

The dispersion of interfacially polymerized grains thus obtained was then processed by a centrifugal separator to sediment capsule toner grains. The upper aqueous phase was removed. A washing water was then added to the emulsion. The mixture was then stirred to redisperse the capsule toner grains. The cleaning procedure was repeated six times so that polyvinyl alcohol attached to the surface of the interfacially polymerized grains, etc. were removed. To the material were then added 100 parts of distilled water. Water content was then removed from the material by means of a freeze dryer to obtain colored capsule toner grains.

To 10 parts of the colored capsule toner grains was then added 2 parts of a hydrophobic silica (R972 available from Nihon Aerogel K.K.) to obtain a toner composition. Eight parts of the toner composition thus obtained was mixed with 100 parts of a carrier made of methyl methacrylatestyrene copolymer-coated ferrite powder having an average grain diameter of 50 μm to prepare a developer.

The developer thus obtained was then evaluated for image quality with a copying machine (Acolor available from Fuji Xerox Co., Ltd.). As a result, a high resolution image with little toner scattering therearound was obtained. The fixing temperature was 120° C. The image intensity was sufficient. Thus, the developer exhibited an excellent low temperature-fixability. The developer was also subjected to a 30,000-sheet copying test in the summer atmosphere (30° C., 80% RH) and the winter atmosphere (10° C., 30% RH). As a result, images with an excellent quality were continuously obtained.

EXAMPLE 2

A developer was prepared in the same manner as in Example 1 except that 1 part of an adduct of 3 mols of xylylene diisocyanate and 1 mol of trimethylolpropane (Takenate D-110N, available from Takeda Chemical Industries, Ltd.) was further incorporated in the oil phase. The developer was then evaluated in the same manner as in Example 1. The capsule toner thus obtained exhibited a volumeaverage grain size of 5.1 μm, a number-average grain diameter of 4.6 μm and a grain size distribution of 1.30. The initial image obtained with the developer had a high resolution. The developer showed no problems with prolonged tests, including environmental change.

EXAMPLE 3

Two parts of a linear polyester resin (Tg: 46° C.; Tm: 79.5° C.; acid value: 2.7; hydroxyl number: 34.4) and 2 parts of a copper phthalocyanine pigment (Phthalocyanine Blue 4933M, available from Dainichi Seika K.K.) were mixed with 200 parts of ethyl acetate, and then treated by means of a sand mill to prepare a dispersion.

In 20 parts of the dispersion were then added 10 parts of the foregoing linear polyester resin, 1 part of p-xylylenediol (m.p. 115°–116° C.), 1 part of an adduct of 3 mols of xylylene diisocyanate and 1 mol of trimethylolpropane (Takenate D-110N, available from Takeda Chemical Industries, Ltd.) and 0.3 parts of methylsilyl triisocyanate (Orgatics SI-310, available from Matsumoto Kosho K.K.) to prepare an oil phase. The preparation of an oil phase mixture (mixture of core material and shell-forming material) was effected with the temperature adjusted to 25° C. or lower. The oil phase mixture was then emulsion-dispersed in 80 parts of a 2 wt. % aqueous solution of carboxymethyl cellulose (Cellogen BS-H, available from Daiichi Seiyaku Co., Ltd.) to obtain an oil-in-water type emulsion comprising oil droplets having a volume-average grain size of 4.0 μm as determined by Coulter counter process. The oil-in-water type emulsion was then stirred in a 40° C. constant temperature bath for 3 hours to complete the interfacial polymerization reaction and desolvating. The dispersion of interfacially polymerized grains thus obtained was then processed by a centrifugal separator to sediment capsule toner grains. The upper aqueous phase was removed. A washing water was then added to the emulsion. The mixture was then stirred to redisperse the capsule toner grains. The cleaning procedure was repeated six times so that carboxymethyl cellulose attached to the surface of the interfacially polymerized grains, etc. were removed. To the material was then added 100 parts of distilled water. Water content was then removed from the material by means of a freeze dryer to obtain colored capsule toner grains. The yield was 95%. The grain shape is shown in FIG. 2. Colored capsule toner grains shown in FIGS. 1 and 3 were also produced in the same manner as described above, except that the amount of the adduct of 3 mols of xylylene diisocyanate and I mol of trimethylolpropane and the amount of methylsilyl triisocyanate were changed to 0.5 parts and 0.15 parts, respectively, for production of the former grains, and to 2 parts and 0.6 parts, respectively, for production of the latter grains.

The colored capsule toner grains as shwon in FIG. 2 exhibited a grain size distribution of 1.22 as determined by Coulter counter process, showing an extremely sharp grain size distribution. The color capsule toner grains exhibited an average grain diameter of 4.1 μm.

To 10 parts of the colored capsule toner grains was then added 0.1 parts of a hydrophobic silica (R972 available from Nihon Aerogel K.K.) to obtain a toner composition. As a carrier there was used a fluorinated acrylic resin-coated ferrite core having an average grain diameter of 40 μm. Twenty parts of the toner was mixed with 400 parts of the carrier to obtain a developer.

The developer thus obtained was then examined for a 10,000-sheet copying test in the summer and winter atmospheres as used in Example 1. As a result, the developer showed little or no image quality change due to test environment and the fluctuation in image quality of the number of copied sheets. Thus, the developer provides a stable image with a high resolution.

COMPARATIVE EXAMPLE 1

The same procedure as in Example 2 was repeated except that methylsilyl triisocyanate was not used. As a result, the oil phase was not emulsified in the aqueous phase, making it impossible to obtain colored grains.

The capsule toner according to the present invention exhibits a sharp grain size distribution and thus provides improvements particularly in carriage of small grain size toner, chargeability, cleaning properties, etc. Further, there is little or no dispersion of chargeability from grain to grain. Thus, fixing can be effected at low temperatures. Accordingly, the use of the capsule toner of the present invention provides a high resolution copied image over an extended period of time.

In accordance with the process for the preparation of a capsule toner according to the present invention, a high resolution toner with an average grain diameter of 1 to 10 μm having a narrower grain size distribution than that obtained by the conventional dry process can be obtained in a high yield. Further, the shape of the capsule toner grains can be arbitarily varied from nearly sphere to amorphous. Accordingly, the present invention provides solution to technical problems with copying machines and printers employing a high resolution toner, e.g., fog, unevenness in the transferring zone and toner miscarriage and thus enables the preparation of a capsule toner suitable for copying machines or printers.

While the invention has been described in detail and with reference to specific embodiments thereof, it will be apparent to one skilled in the art that various changes and modifications can be made therein without departing from the spirit and scope thereof.

What is claimed is:

1. A capsule toner comprising binder resin, colorant, toner additive and shell obtained by dispersing an oil phase containing a binder resin and a colorant in an aqueous medium in the form of oil droplets and effecting a reaction of one or more capsule shell-forming monomers inside and/or on the interface of the oil droplets to form capsule shells, wherein a silylisocyanate compound is added in the oil phase as a capsule shell-forming monomer.

2. A capsule toner obtained by dispersing an oil phase containing a binder resin and a colorant in an aqueous medium in the form of oil droplets and effecting a reaction of at least a first capsule shell-forming monomer and a second capsule shell-forming monomer inside and/or on the interface of the oil droplets to form capsule shells, wherein a silylisocyanate compound and a polyvalent isocyanate compound are added in the oil phase as capsule shell-forming monomers and a cellulose high molecular compound is added in the aqueous medium.

3. The capsule toner as in claim 1, wherein said silylisocyanate compound is a silylisocyanate derivative selected from the group consisting of the following general formulae (I), (II), (III) and condensates thereof:

$$R_mR'_kR''_nSi(NCO)_{4-m-k-n} \quad (I)$$

$$(RO)_m(R'O)_k(R''O)_nSi(NCO)_{4-m-k-n} \quad (II)$$

$$R_p(R'O)_qSi(NCO)_r \quad (III)$$

wherein R, R′ and R″ each represents an alkyl group, aryl group or alkenyl group; m, k and n each represents an integer of 0 to 3, with the proviso that m, k and n satisfy the relationship $m+K+n \leqq 3$; and p, q and r each represents an integer of 1 or 2, with the proviso that p, q and r satisfy the equation $p+q+r=4$.

4. The capsule toner as in claim 2, wherein said silylisocyanate compound is a silylisocyanate derivative selected from the group consisting of the following general formulae (I), (II), (III) and condensates thereof:

$$R_mR'_kR''_nSi(NCO)_{4-m-k-n} \quad (I)$$

$$(RO)_m(R'O)_k(R''O)_nSi(NCO)_{4-m-k-n} \quad (II)$$

$$R_p(R'O)_qSi(NCO)_r \quad (III)$$

wherein R, R′ and R″ each represents an alkyl group, aryl group or alkenyl group; m, k and n each represents an integer of 0 to 3, with the proviso that m, k and n satisfy the relationship $m+K+n \leqq 3$; and p, q and r each represents an integer of 1 or 2, with the proviso that p, q and r satisfy the equation $p+q+r=4$.

5. The capsule toner as in claim 1, wherein said silylisocyanate compound is added in an amount of 0.0001 to 0.5 parts by weight per part by weight of the total weight of the binder resin and the colorant.

6. The capsule toner as in claim 2, wherein said silylisocyanate compound is added in an amount of 0.0001 to 0.5 parts by weight per part by weight of the total weight of the binder resin and the colorant.

7. The capsule toner as in claim 1, wherein said silylisocyanate compound is added in an amount of 0.01 to 0.10 parts by weight per parts by weight of the total weight of the binder resin and the colorant.

8. The capsule toner as in claim 1, wherein said binder resin is a linear polyester comprising a polycondensate of a polyol component with a polyvalent carboxylic acid, acid anhydride thereof or lower alkylester thereof.

9. The capsule toner as in claim 1, wherein the aqueous medium comprises a surface active agent.

10. The capsule toner as in claim 1, wherein the aqueous medium comprises a protective colloid.

11. The capsule toner as in claim 1, wherein the toner additive is selected from the group consisting of an antistatic agent, a fixing aid and a fluidizer.

12. The capsule toner as in claim 2, wherein said silylisocyanate compound is added in an amount of 0.01 to 0.10 parts by weight per parts by weight of the total weight of the binder resin and the colorant.

13. The capsule toner as in claim 2, wherein said binder resin is a linear polyester comprising a polycondensate of a polyol component with a polyvalent carboxylic acid, acid anhydride thereof or lower alkylester thereof.

14. The capsule toner as in claim 2, wherein the aqueous medium comprises a surface active agent.

15. The capsule toner as in claim 2, wherein the aqueous medium comprises a protective colloid.

* * * * *

UNITED STATES PATENT AND TRADEMARK OFFICE

CERTIFICATE OF CORRECTION

PATENT NO. 5,441,840

DATED August 15, 1995

INVENTOR(S): Takashi IMAI, Takeshi AGATA, Takeshi MIKAMI and Yoshihiro INABA

It is certified that error appears in the above-indentified patent and that said Letters Patent is hereby corrected as shown below:

On the title page, item [75] please change the third-named inventor's first name from "Tadeshi" to --Takeshi--.

Signed and Sealed this

Fourteenth Day of November, 1995

*Attest:*

*Attesting Officer*

BRUCE LEHMAN

*Commissioner of Patents and Trademarks*